US009572733B1

(12) United States Patent
Lai et al.

(10) Patent No.: US 9,572,733 B1
(45) Date of Patent: Feb. 21, 2017

(54) FOLDING WHEELCHAIR WITH AN EXCRETION DEVICE

(71) Applicants: Cheng-Piao Lai, Taoyuan (TW); Ting-Yu Lai, Taoyuan (TW)

(72) Inventors: Cheng-Piao Lai, Taoyuan (TW); Ting-Yu Lai, Taoyuan (TW)

( * ) Notice: Subject to any disclaimer, the term of this patent is extended or adjusted under 35 U.S.C. 154(b) by 0 days.

(21) Appl. No.: 15/194,879

(22) Filed: Jun. 28, 2016

(51) Int. Cl.
*A61G 5/10* (2006.01)
*A61G 5/08* (2006.01)
*A61G 5/12* (2006.01)

(52) U.S. Cl.
CPC ..... *A61G 5/1002* (2013.01); *A61G 5/08* (2013.01); *A61G 5/12* (2013.01); *A61G 2005/0825* (2013.01); *A61G 2005/1051* (2013.01); *A61G 2005/125* (2013.01)

(58) Field of Classification Search
CPC ..... A61G 5/1002; A61G 5/08
See application file for complete search history.

(56) References Cited

U.S. PATENT DOCUMENTS 5,568,933 A * 10/1996 Mizuno ..... A61G 5/08 280/250.1

* cited by examiner

*Primary Examiner* — John Walters
*Assistant Examiner* — James Triggs
(74) *Attorney, Agent, or Firm* — Rosenberg, Klein & Lee

(57) ABSTRACT

A folding wheelchair with an excretion device has an opening at a center of a seat for engagement with an excretion device. The excretion device includes two movable boards with soft pads thereon for placement in the opening when the movable boards are closed, two corresponding operate units, each arranged from a bottom surface of one of the movable board to a side thereof for operation, and a container bag for taking excrement.

7 Claims, 21 Drawing Sheets

FOLDING WHEELCHAIR WITH AN EXCRETION DEVICE

BACKGROUND OF THE INVENTION

1. Field of the Invention

The present invention relates to a folding wheelchair, particularly to one that has an excretion device installed thereon for its user to perform excretion while sitting on the wheelchair.

2. Description of the Related Art

As senior population increasing rapidly, wheelchairs have gained more attention in our society. Wheelchairs are not only needed for the disabled and wounded, but also for elders who need extra help and support in daily life. Therefore, various kinds of wheelchairs are developed to satisfied different needs for the users.

FIG. 1 shows a commonly known folding wheelchair 10 in the field. Considering easy carrying and convenient storage, the folding wheelchair 10 basically has a symmetrical chair frame 11 with a cross brace 12. Two wheels 13 are symmetrically arranged aside the chair frame 11 and two casters 14 are symmetrically arranged in a lower front of the chair frame 11. A seat 15 is disposed in-between the chair frame 11. Two symmetrical back frames 16 and two push handles 17 are extended upwardly from the chair frame 11. Between the back frames 16 there is a backrest 16 disposed. Such design makes the wheelchair portable and enables its users to carry it with them. However, when the users have the need for excretion, they have to move themselves to the toilets—in some cases, their caregivers have to do the job, which requires a great effort. The problem is even worse when the user is seriously disabled or badly injured.

FIGS. 2A and 2B display a foldable wheelchair 10A with urination and defecation functions. Such wheelchair has a different structure from the one disclosed above in that the foldable wheelchair 10A has a chair frame 120 assembled to a cross brace 121 and a seat 130 disposed on the chair frame 120, and that a container 140 is disposed under the chair frame 120 for its users to excrete thereon. However, such design has to remove the seat 130 and the container 140 before folding up the wheelchair 10A, causing more inconveniences. On the other hand, the seat 130 has an opening 131 arranged at the center thereof for excretion. If the users have to sit on the wheelchair 10A for a long period other than excreting, it is obviously uncomfortable. There are various wheelchairs with similar functions in the markets, but the problem of removing the components before folding still remains. In other words, there is still something to be desired.

SUMMARY OF THE INVENTION

The present invention aims to provide a folding wheelchair with an excretion device that enables its users to perform excretion while sitting thereon in addition to its original functions as a normal wheelchair.

To achieve the object, the present invention includes a foldable chair frame having two symmetrically push handles arranged at a rear thereof and two armrests symmetrically arranged aside thereof; a cross brace including a plurality of crossed members to be connected to the chair frame for stable folding and unfolding; a foldable seat connecting the chair frame in-between; a foldable backrest disposed on a back frame connected to the chair frame; two wheels symmetrically arranged aside the chair frame; two casters symmetrically arranged under a lower front of the chair frame; wherein the seat has an opening corresponding to a sitting position of buttocks of human body, and wherein an excretion device is disposed under the opening of the seat.

The excretion device includes two arranged symmetrically adjacent under the opening with surface areas greater than the opening, each movable board having a near side as a free end, a far side fixed to a bottom surface of the seat by a positioning element, thereby to be opened downwards and closed back, and a pad disposed on an upper surface thereof to fit in the opening when the movable board is closed; two operate units arranged symmetrically from bottom surfaces of the movable boards to both sides of the chair frame to operate opening and closing of the movable boards, each including a connecting unit having three sets of connecting bars, among which a pair of first connecting bars has an end thereof individually connected to one of the movable boards by a pair of first hinges and the other end thereof individually connected to an end of a pair of second connecting bars by a pair of second hinges; each second hinge further engages a set of sliding chutes for displacement; the second connecting bars having the other ends individually connected to an end of a pair of third connecting bars which displaces along a sliding rail arranged under one of the armrests, thereby opening and closing the connected movable boards with vertical displacement of the third connecting bars; and a plurality of hooks arranged under the adjacent sides of the movable boards along edges thereof; a container bag made of waterproof materials with an opened end which includes a plurality of holes along adjacent edges of the opened end corresponding to positions of the hooks for the container bag to be hung up under the movable boards and to be propped open for taking excrement when the movable boards are opened.

Advantageously, the present invention has a wash device. The wash device includes a spray disposed between the seat and the crossed members towards the opening; a detachable water container disposed on the chair frame with an outlet connecting to a pump; and a tube connecting to the pump with an end and to the spray with the other end.

With structures disclosed above, the present invention has common functions as normal wheelchairs of being portable and foldable; additionally, it allows its users to perform excretion directly thereon and has a wash device for further cleansing. The design is therefore convenient for reducing burdens for caregivers and avoiding embarrassing situations for users.

DETAILED DESCRIPTION OF THE PREFERRED EMBODIMENT

Figure 1:
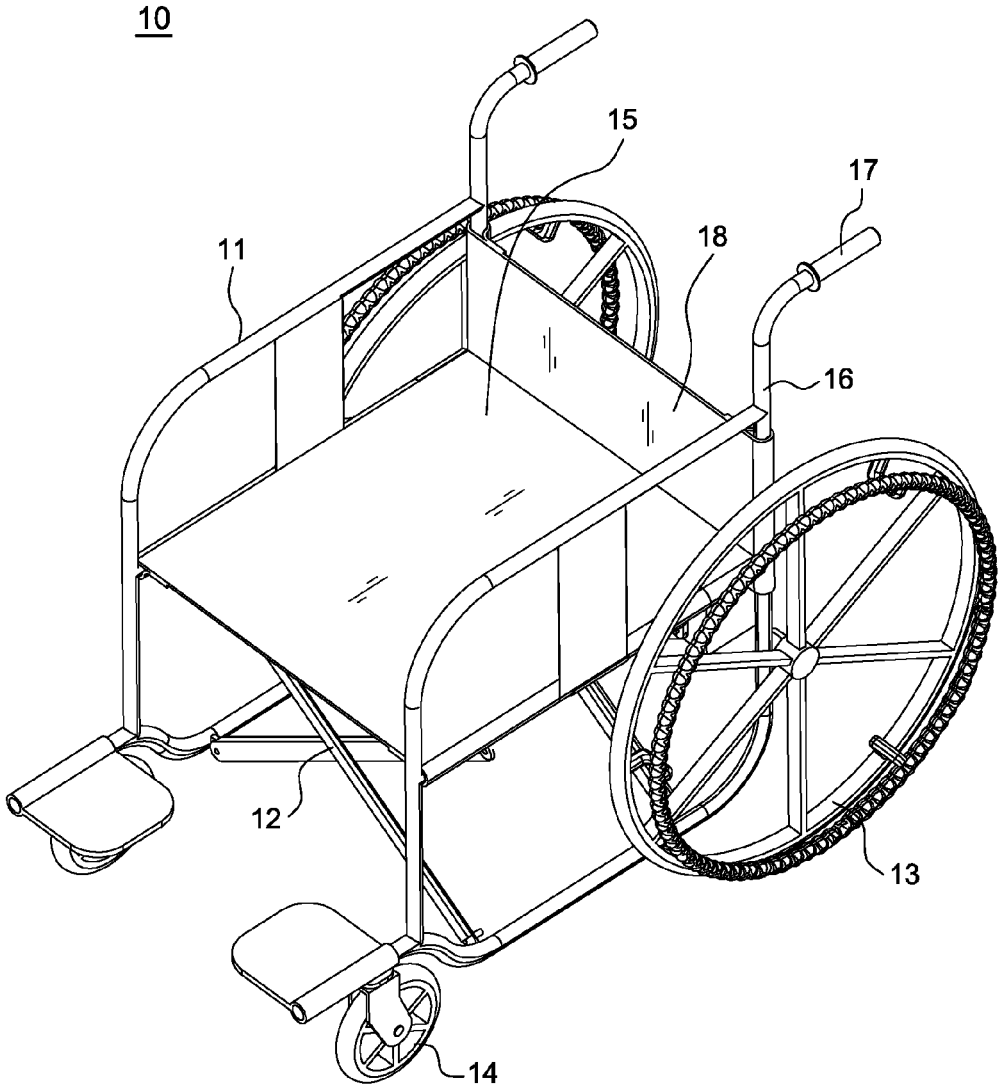
FIG.1 PRIOR ART
FIG. 1 is a perspective view of a conventional wheelchair.
Figure 2A:
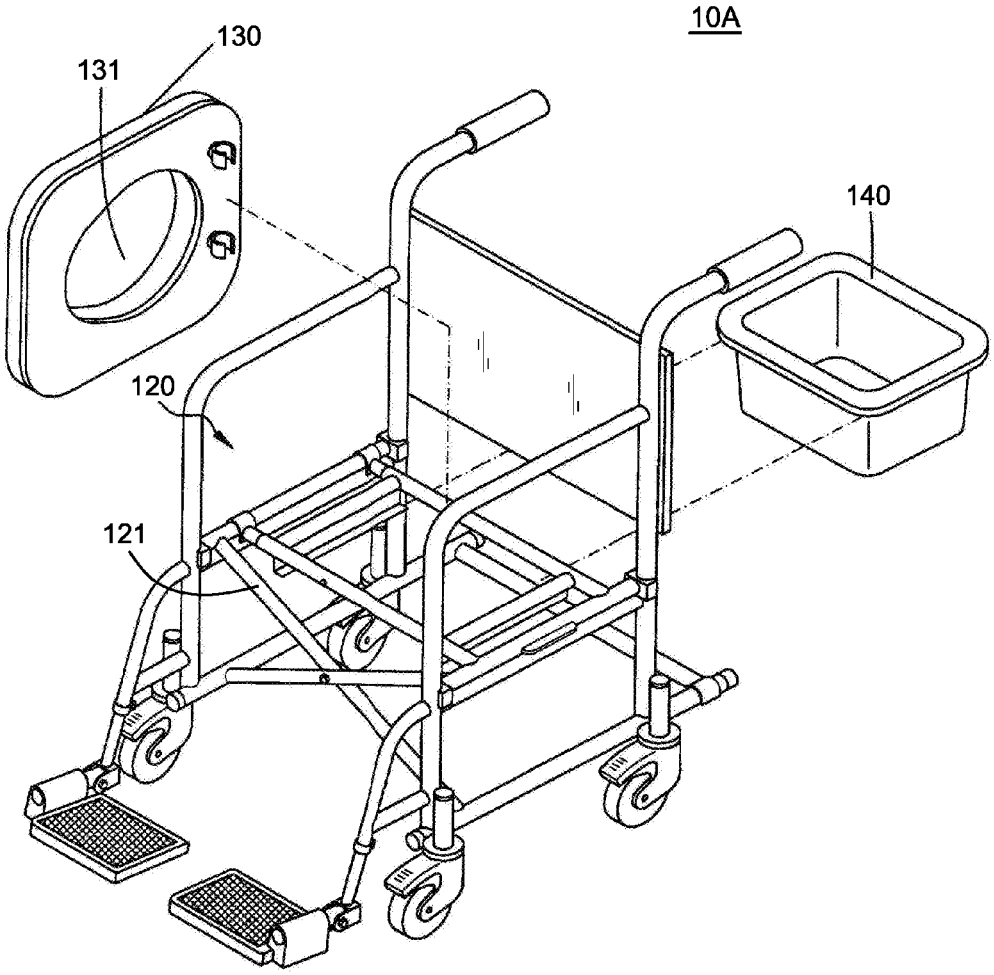
FIG.2A PRIOR ART
FIG. 2A is an exploded view of a conventional wheelchair with designs for excretion thereon.
Figure 2B:
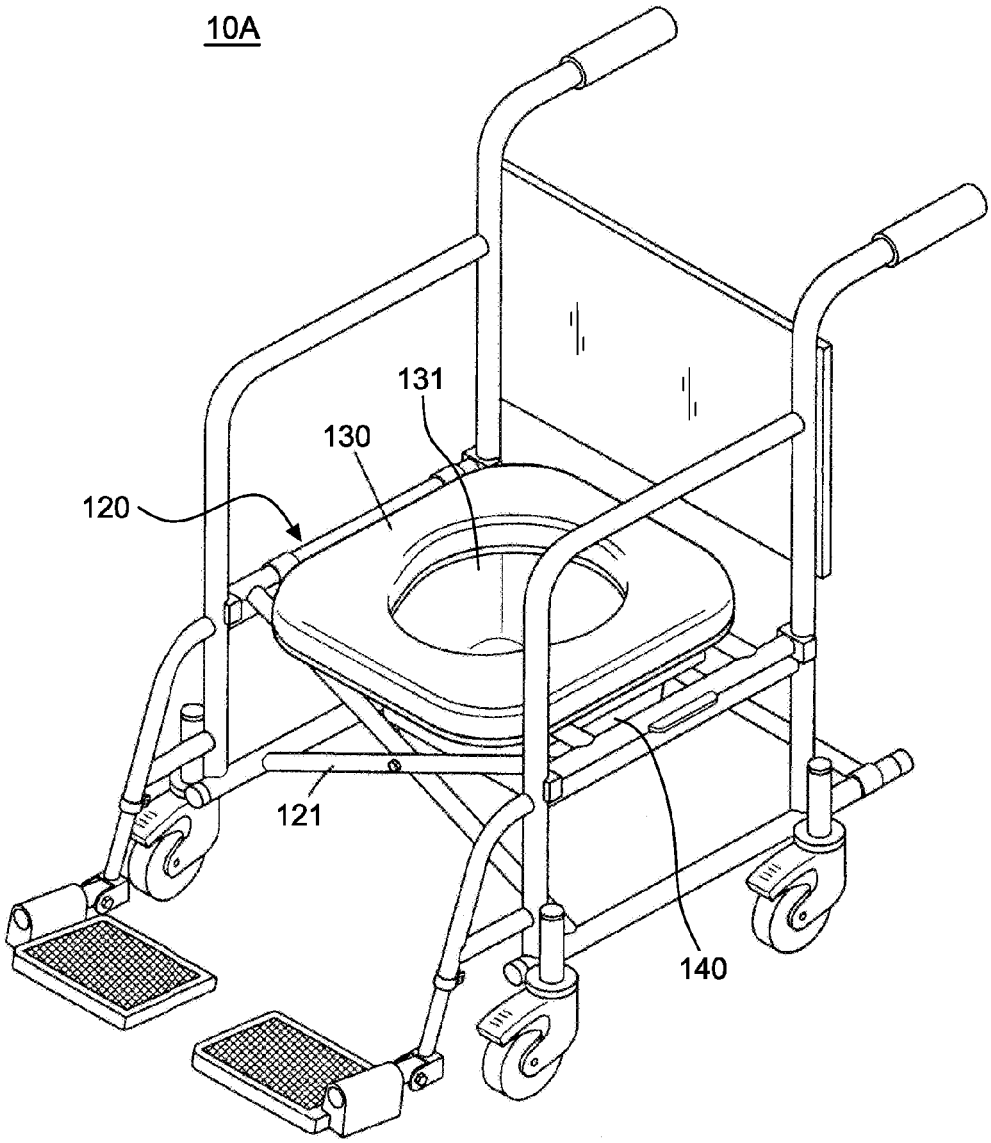
FIG.2B PRIOR ART
FIG. 2B is a perspective view of the wheelchair in FIG. 2A.
Figure 3:
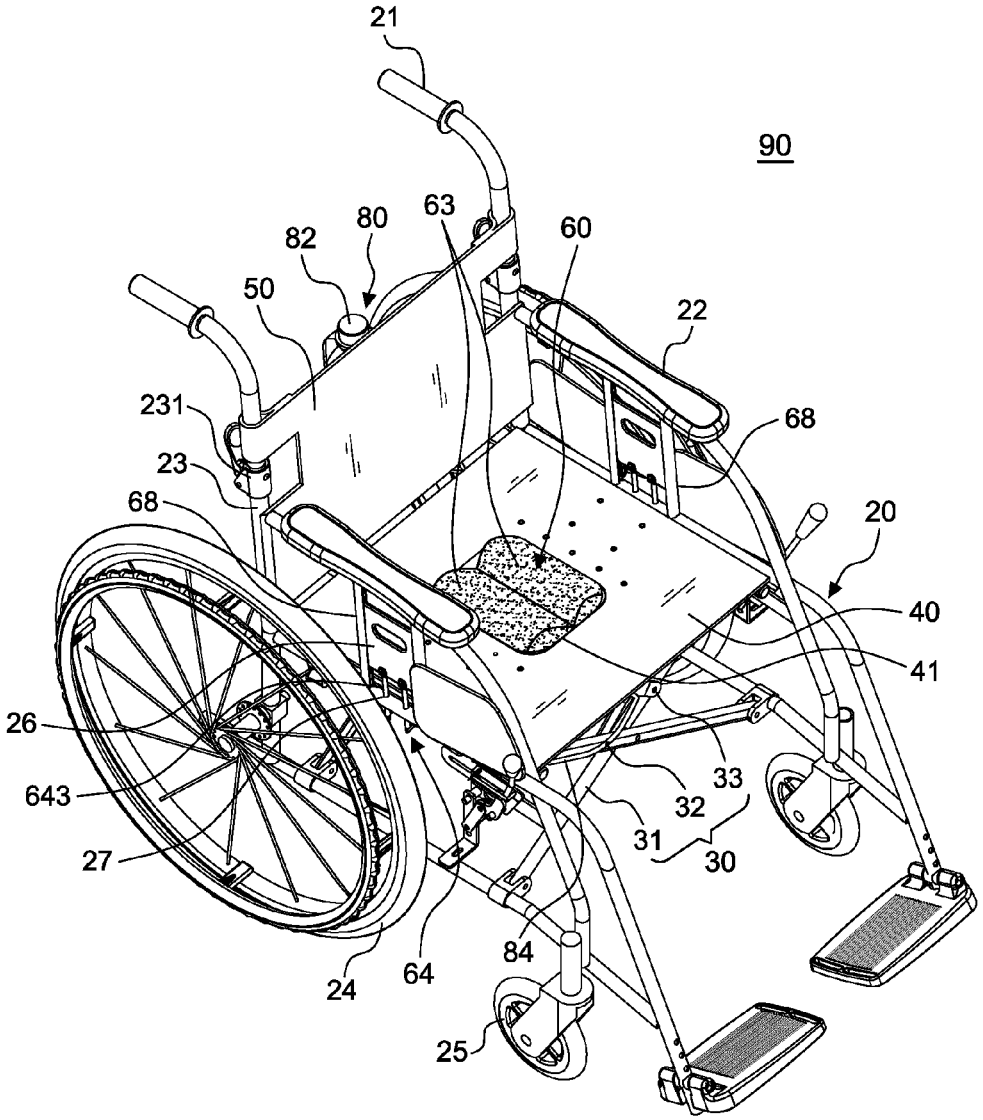
FIG. 3 is a perspective view of the present invention in a preferred embodiment.

Referring to FIGS. 3-10B, in a preferred embodiment, the present invention includes a foldable chair frame 20, a cross brace 30, a foldable seat 40, a foldable backrest 50, two wheels 24, two casters 25, an opening 41, an excretion device 60, and a wash device 80.

The chair frame 20 has two push handles 21 symmetrically arranged at a rear thereof and two armrests 22 symmetrically arranged aside thereof. The cross brace 30 includes a plurality of crossed members 31 to be connected to the chair frame 20 for stable folding and unfolding. The seat 40 is disposed in-between the chair frame 20. The backrest 50 is disposed on a back frame 23 connected to the chair frame 20. The wheels 24 are symmetrically arranged aside the chair frame 20. The casters 25 are symmetrically arranged under a lower front of the chair frame 20.

Such structure of a folding wheelchair is already commonly known in the prior art. The features of the present invention lies in that the seat 40 has the opening 41 arranged corresponding to a sitting position of buttocks of human body, and that the excretion device 60 is disposed under the opening 41 of the seat 40 for convenient excretion on the wheelchair.

The excretion device 60 includes two movable boards 61, two operate units 64, a plurality of hooks 69, and a container bag 70.

Figure 7:
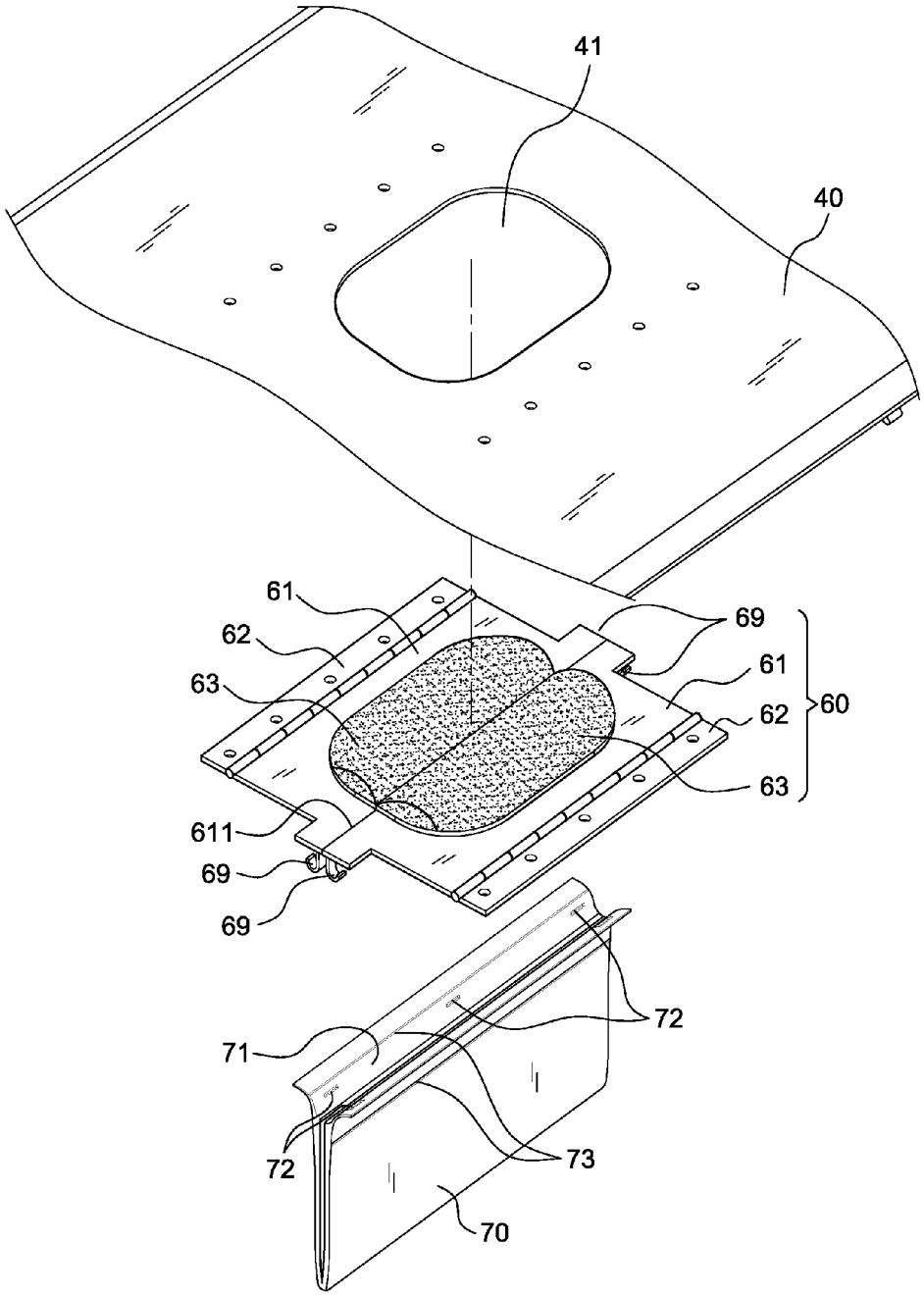
FIG. 7 is an exploded view of an excretion device thereof.
Figure 8:
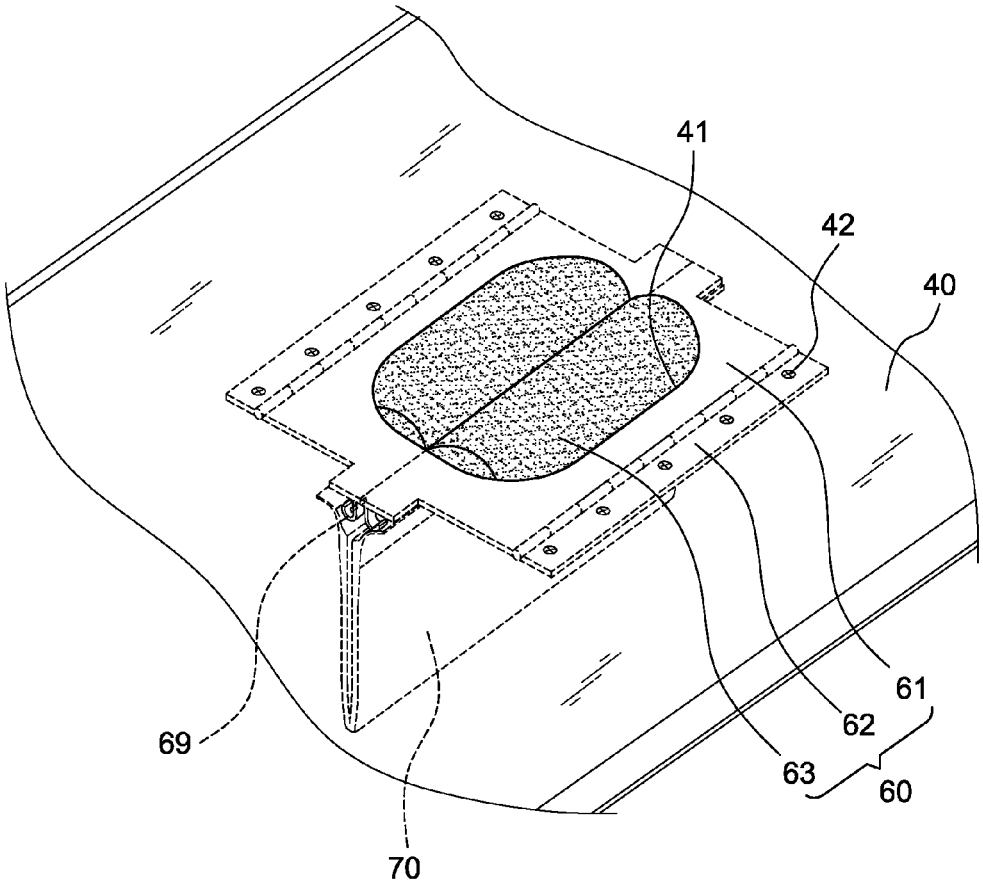
FIG. 8 is a perspective view of the excretion device.

With reference to FIGS. 7 and 8, the movable boards 61 are arranged symmetrically adjacent under the opening 41 with surface areas greater than the opening 41. In this embodiment, the movable boards 61 are made of plastics; each of which has a near side as a free end and a far side fixed to a bottom surface of the seat 40 by a positioning element 62; in this embodiment, the positioning element 62 is fixed by a plurality of rivets 42. The movable boards 61 are thereby opened downwards and closed back for operation. Moreover, two pads 63 are disposed on upper surfaces of the movable boards 61 to fit in the opening 41 when the movable boards 61 are closed; the pads 63 might be at the same height or slightly higher than a plan surface of the opening 41.

Figure 10A:
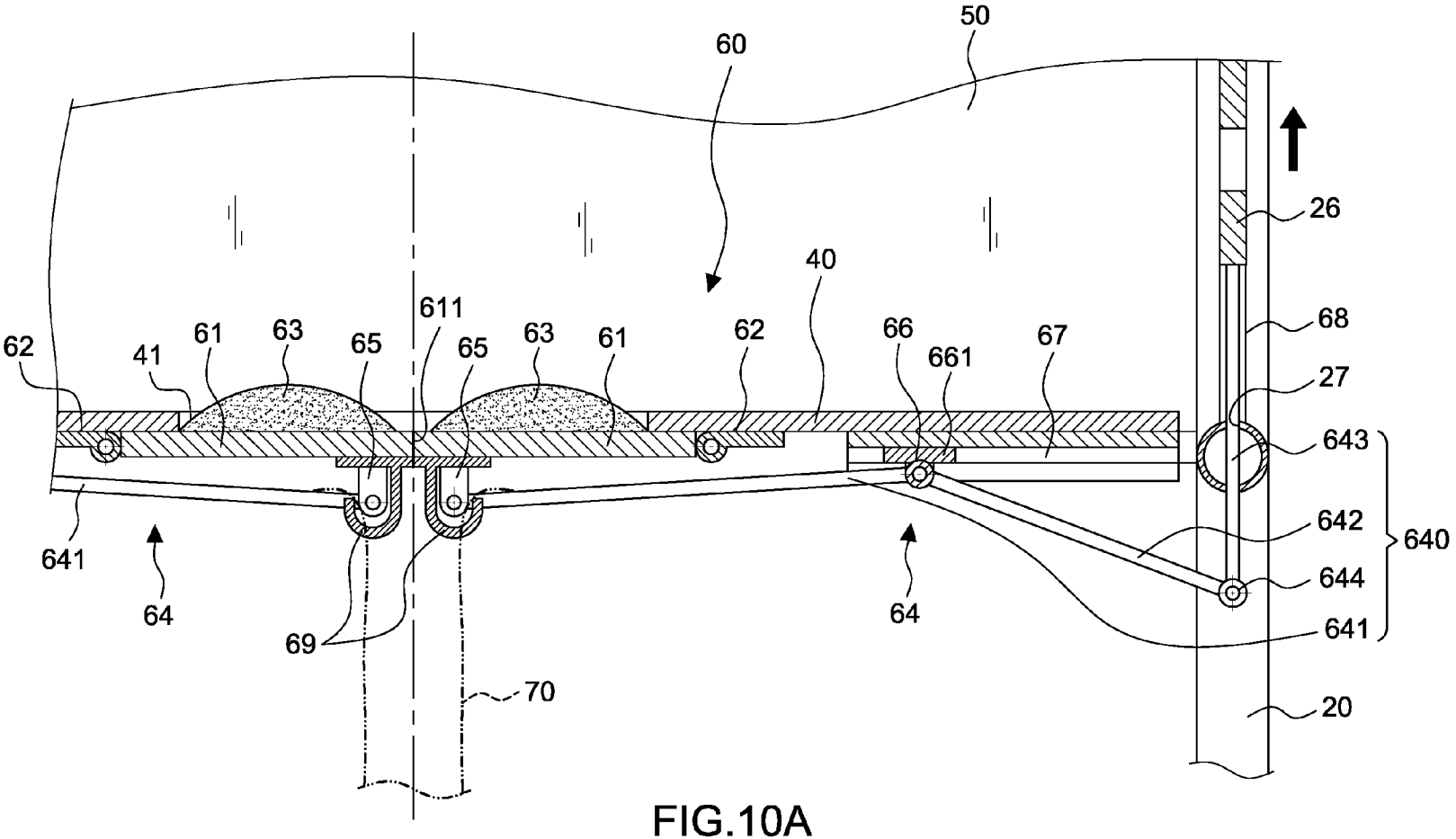
FIG. 10A is a sectional view along line 10A-10A in FIG. 9C.
Figure 10B:
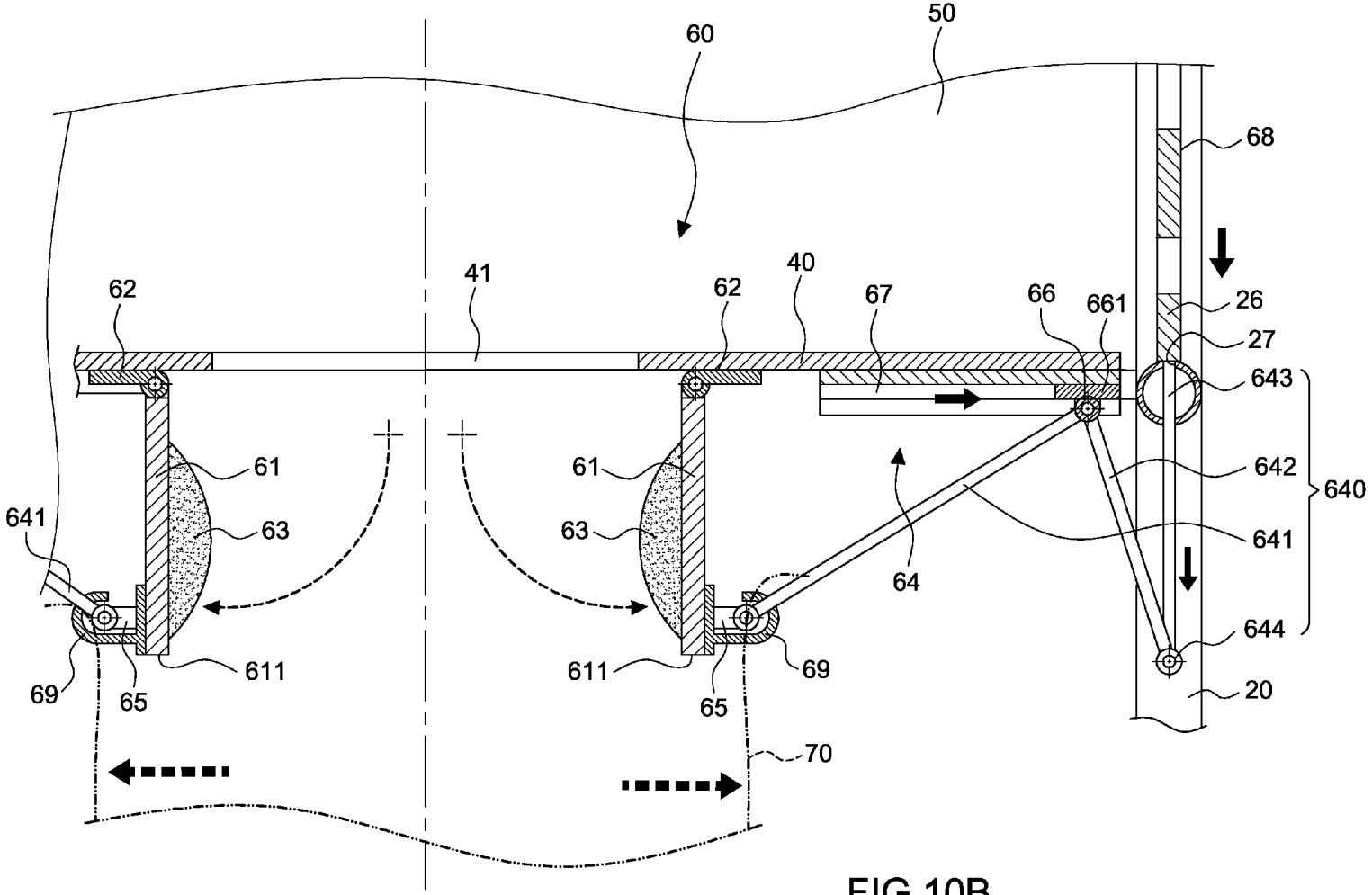
FIG. 10B is a sectional view of the present invention illustrating the excretion device in operation.

The operate units 64 are arranged symmetrically from bottom surfaces of the movable boards 61 to both sides of the chair frame 20 to operate opening and closing as illustrated in FIGS. 10A and 10B. Each of the operate unit 64 includes a connecting unit 640 having at least three sets of connecting bars, among which a pair of first connecting bars 641 has an end thereof individually connected to one of the movable boards 61 by a pair of first hinges 65, and the other end thereof individually connected to an end of a pair of second connecting bars 642 by a pair of second hinges 66. Each of the second hinges 66 further engages a set of sliding chutes 67 for displacement. In this embodiment, the second hinges 66 further has a sliding block 661 to displace along the sliding chutes 67 for operation. The second connecting bars 642 have the other ends individually connected to an end of a pair of third connecting bars 643 in pivotal connection 644. The third connecting bars 643 can also displace along two sliding rails 68 correspondingly arranged under the armrests 22, thereby opening and closing the connected movable boards 61 with vertical displacement thereof.

In this embodiment, each pair of the third connecting bars 643 further has a push plate 26 disposed atop for engagement, and a lower end of the third connecting bars 643 individually engages through a through hole 27 arranged correspondingly on the chair frame 20 for operation. As shown in FIG. 10B, when the push plate 26 is pushed downwards, forcing the third connecting bars 643 to displace, the second and first connecting bars 642, 641 are thereby displaced due to the pivotal connections, so as to open the connected movable board 61 for a user to excrete. Oppositely, when the push plate 26 is pulled upwards, simultaneously pulling up the third connecting bars 643, the second and first connecting bars 642, 641 are thereby displaced back to original positions, so as to close the connected movable board 61 as shown in FIG. 10A. Since the operate units 64 are arranged correspondingly under the armrests 22, it can be easily operated by the users.

Figure 12:
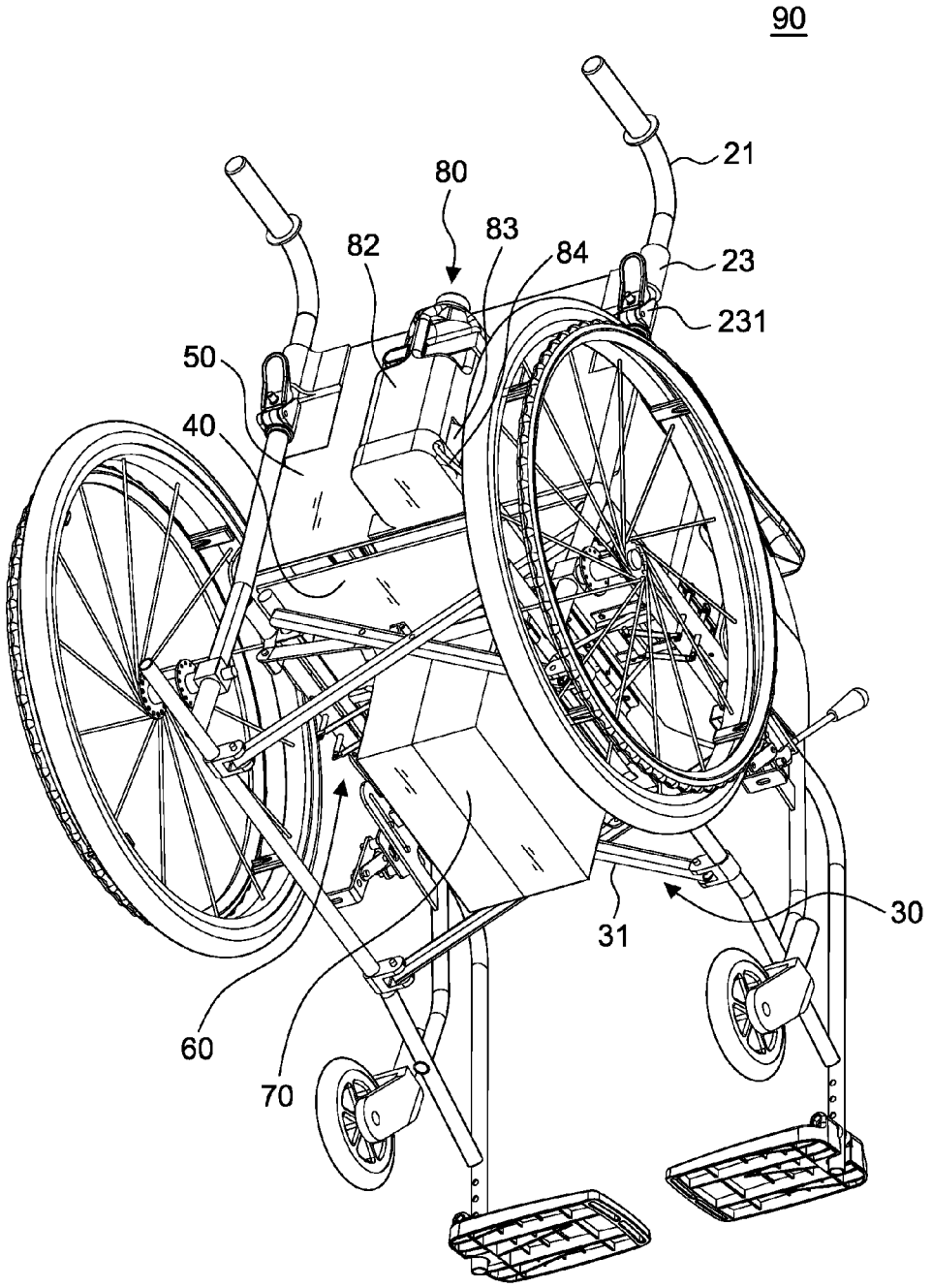
FIG. 12 is a perspective view of the present invention showing the container bag propped open under the excretion device.

The hooks 69 are arranged correspondingly under the adjacent sides of the movable boards 61 along edges thereof. Referring to FIGS. 7 and 7A, the container bag 70 is made of waterproof materials with an opened end 71 which includes a plurality of holes 72 along adjacent edges of the opened end 71 corresponding to positions of the hooks 69 for the container bag 70 to be hung up under the movable boards 61 and to be propped open for taking excrement when the movable boards 61 are opened as shown in FIGS. 10B and 12. In the embodiment, the opened end 71 of the container bag 70 has two zippers 73 as one arranged above the holes 72 while the other arranged below to ensure the hooking would not be easily detached. Furthermore, according to FIG. 7B, the container bag 70 can be conveniently sealed after use with the zippers 73. The excretion device 60 in FIGS. 3-10A illustrated detailed structures thereof before the container bag 70 being hung up to the hooks 69.

Figure 11:
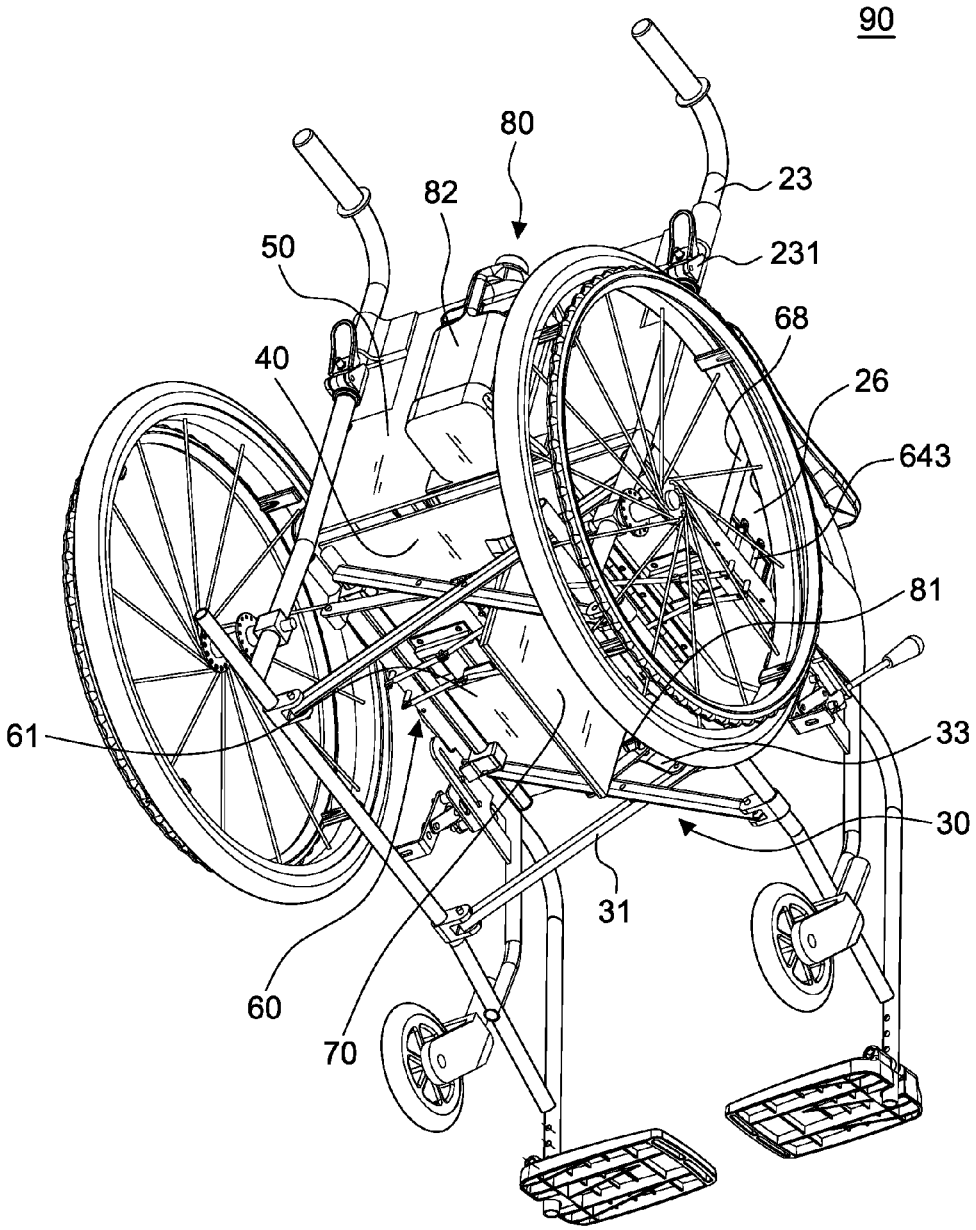
FIG. 11 is a perspective view of the present invention showing the closed container bag hung under the excretion device.
Figure 13:
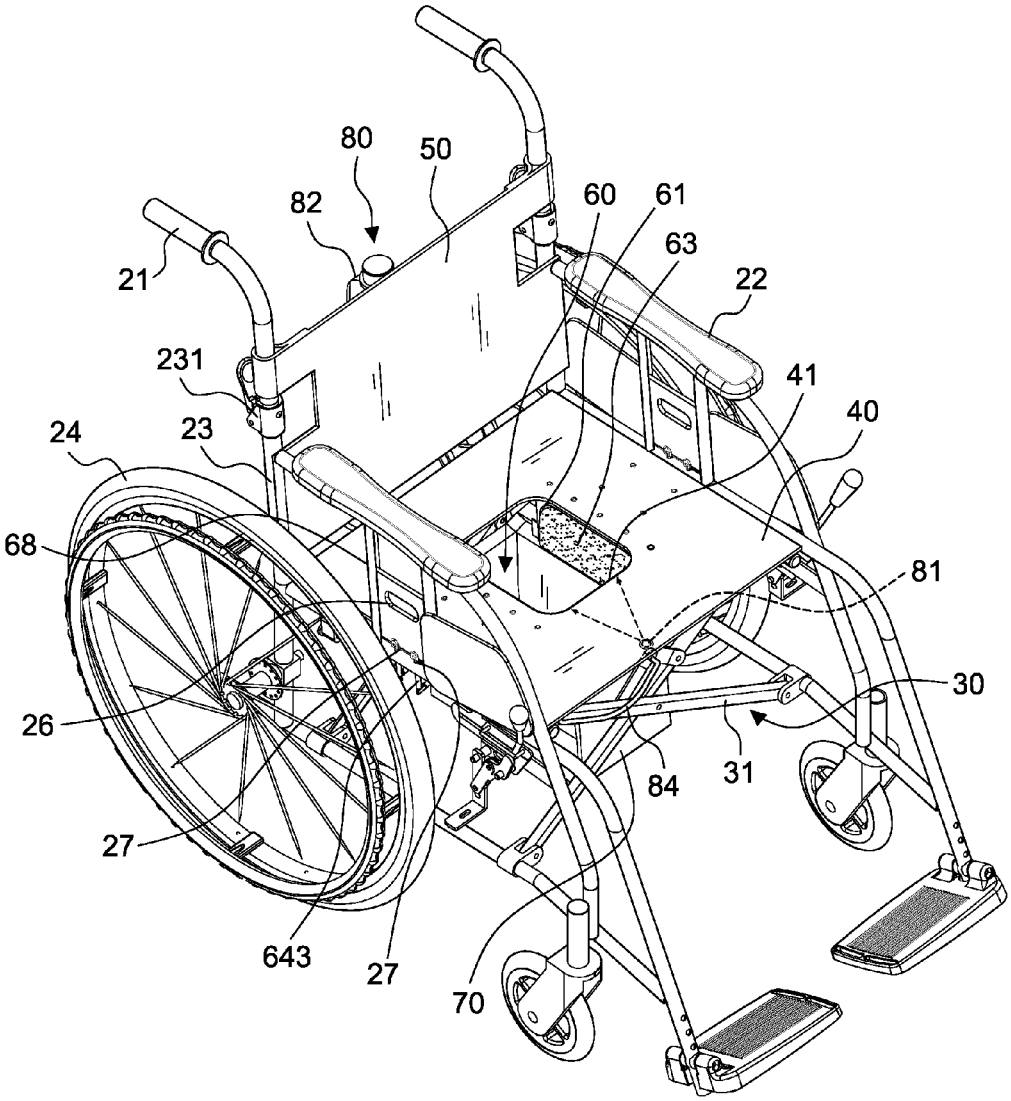
FIG. 13 is a perspective view of the present invention showing the excretion device in operation with the container bag propped open thereunder.
Figure 14:
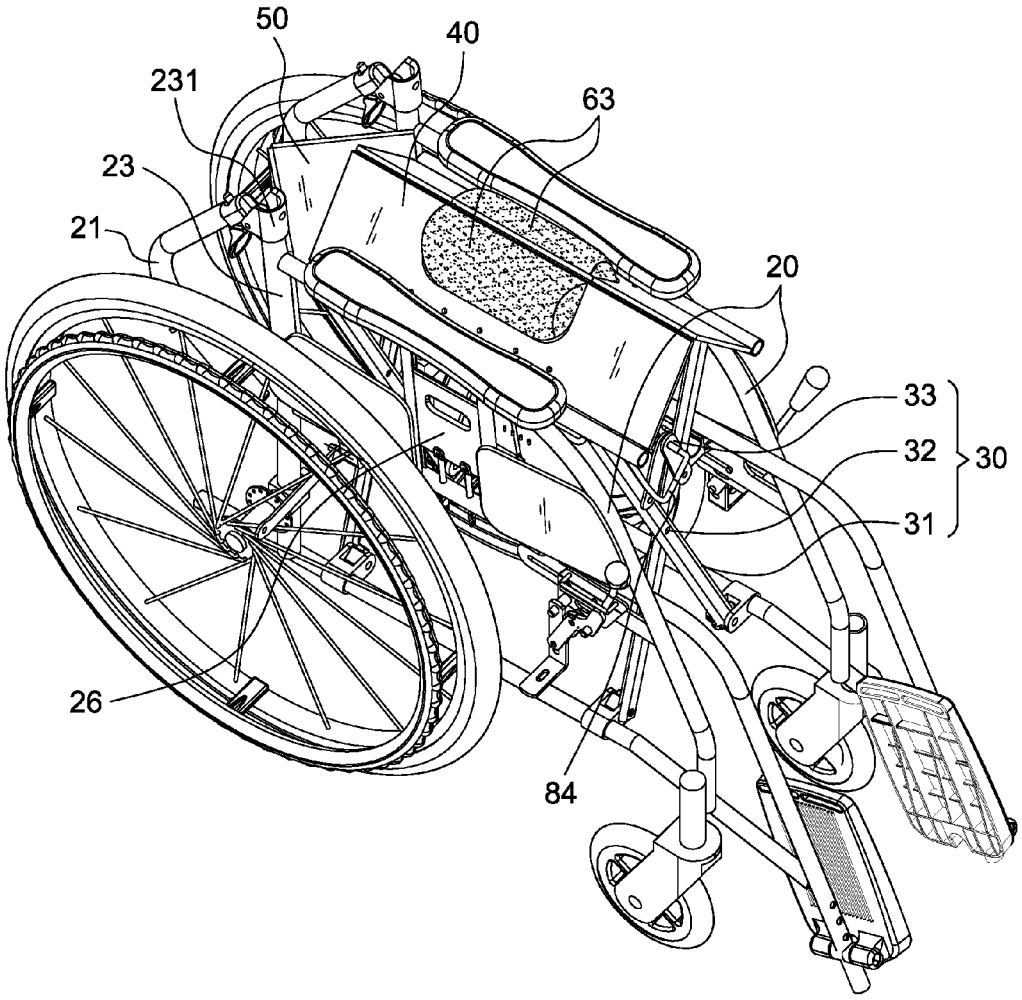
FIG. 14 is a perspective view of the present invention folded.

FIG. 11 shows the present invention as a normal wheel chair with the container bag 70 hung up under the closed movable boards 61. When its users need to excrete, the present invention is able to operate immediately—simply push down the push plates 26 to displace the third connecting bars 643 and further displace the second and first connecting bars 642, 641 in order to open the movable boards 61 and simultaneously prop open the container bag 70 as shown in FIGS. 12 and 13. The user is therefore able to excrete right on the wheelchair with an excretion device 90 conveniently. On the other hand, when the user is going out somewhere, the present invention is also foldable for easy carrying as shown in FIG. 14. Additionally, in the embodiment there is a folding section 231 arranged on the back frame 23 to be further folded.

Figure 4A:
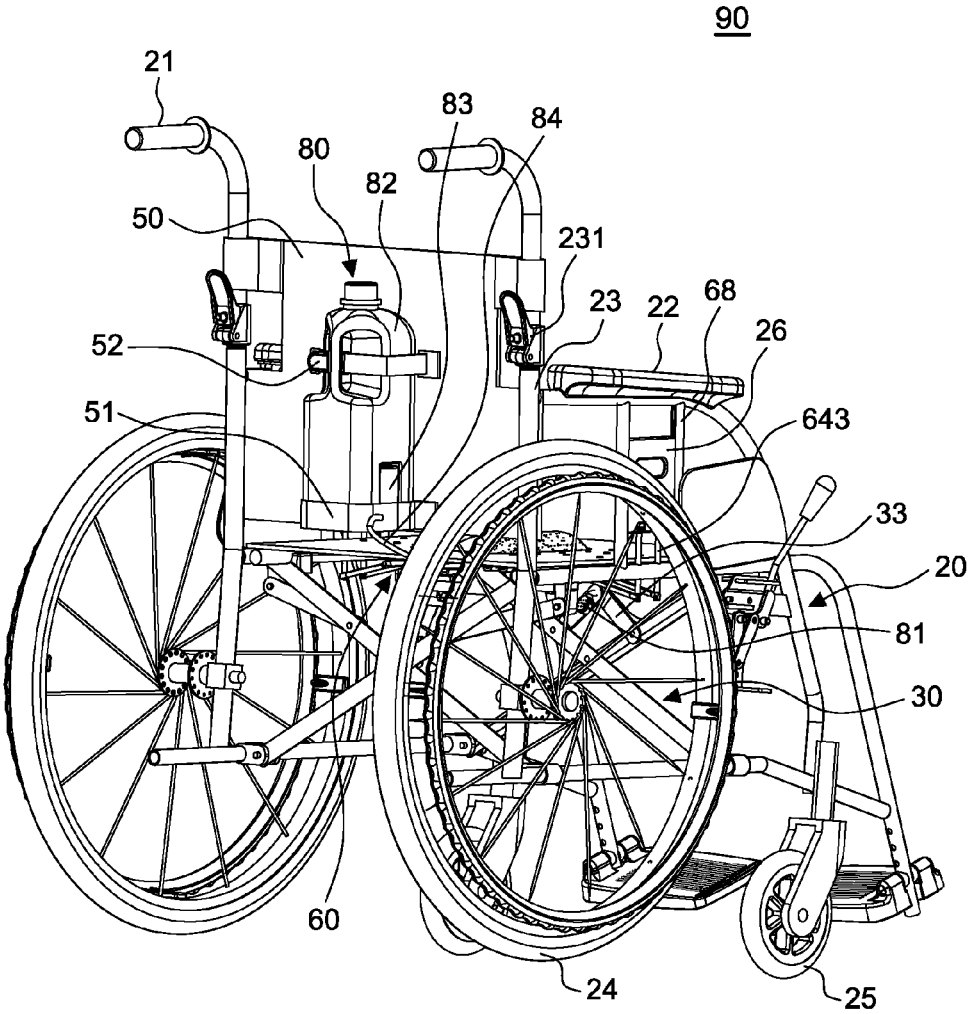
FIG. 4A is another perspective view of FIG. 3 from a different angle of view.
Figure 4B:
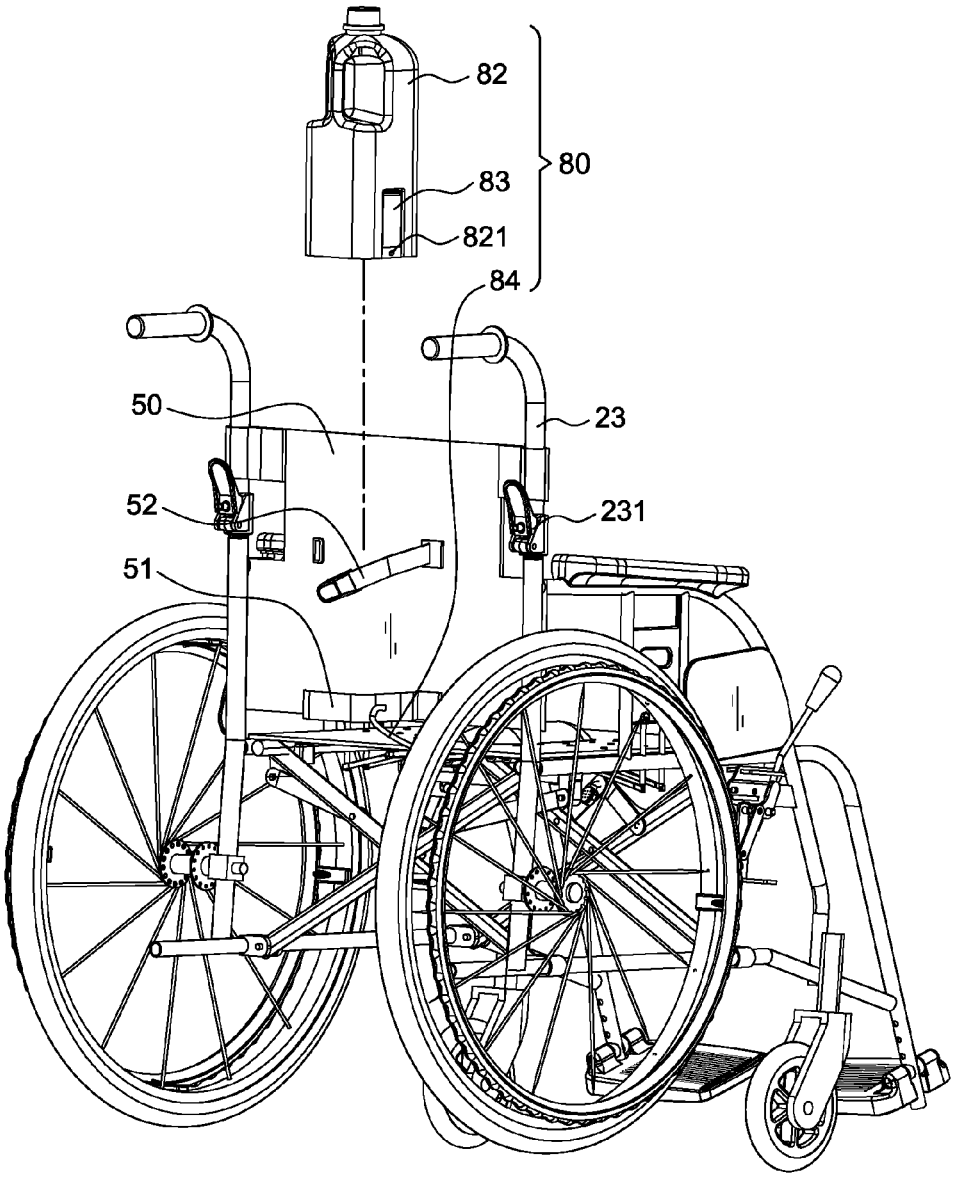
FIG. 4B is a schematic diagram of FIG. 4A illustrating a wash device thereof detached from the present invention.
Figure 5:
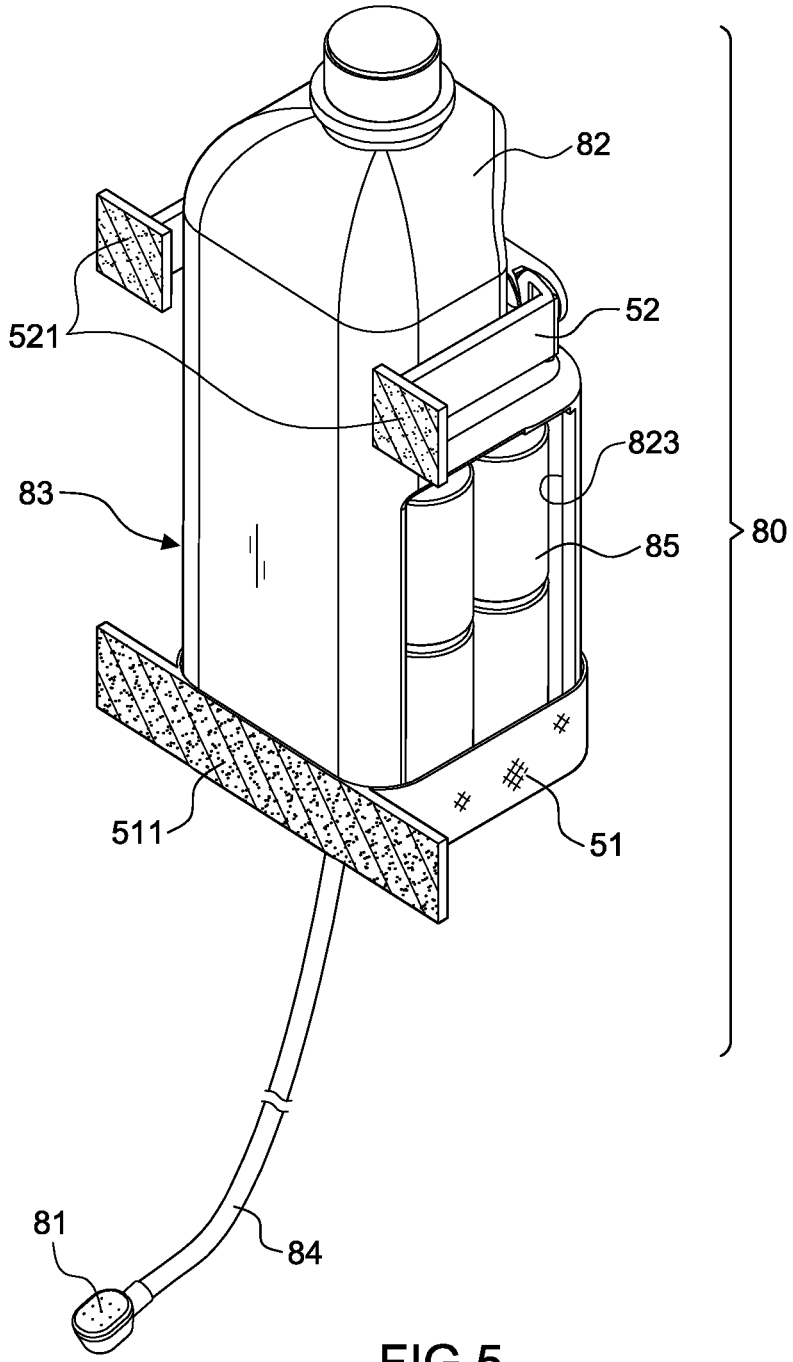
FIG. 5 is a perspective view of the wash device thereof.
Figure 6:
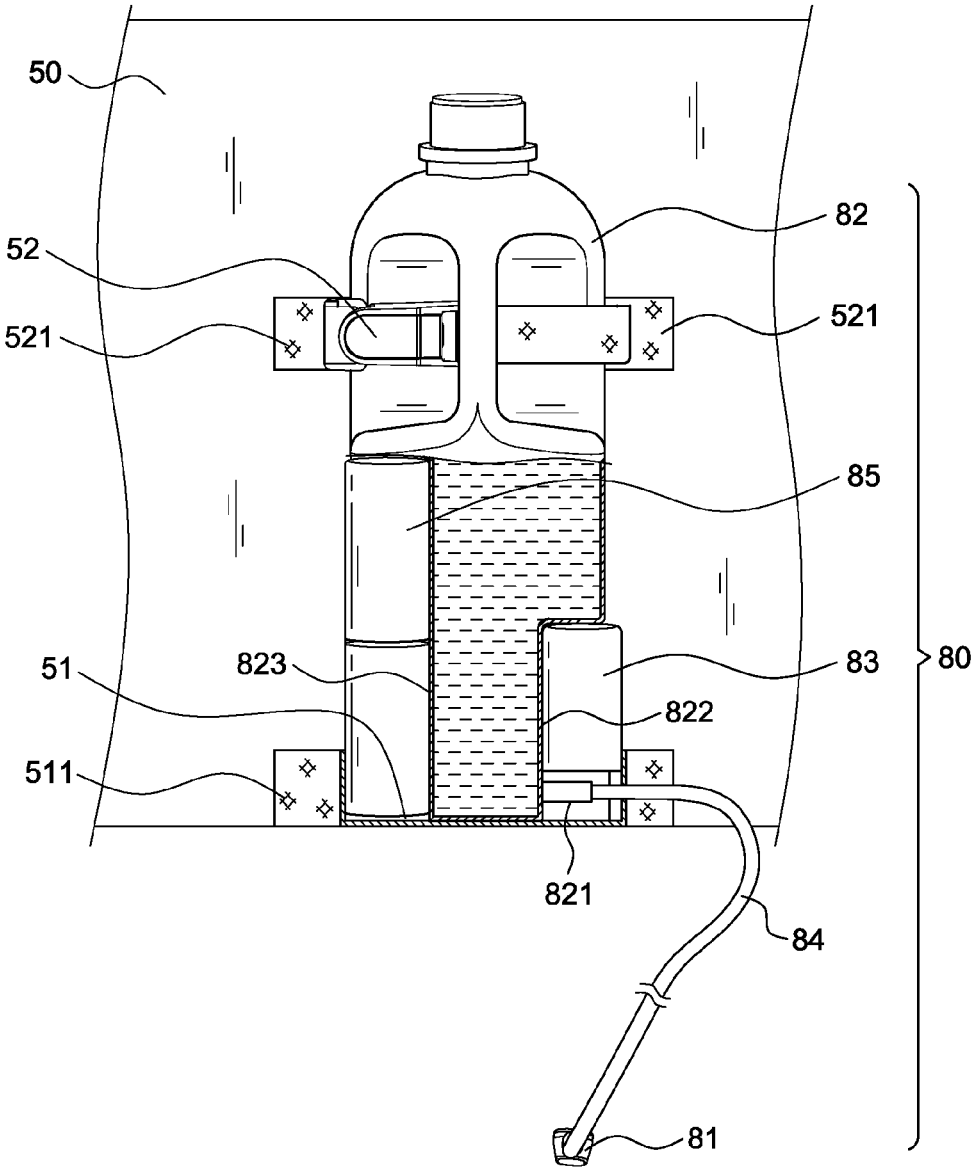
FIG. 6 is a sectional view of the wash device thereof.
Figure 7A:
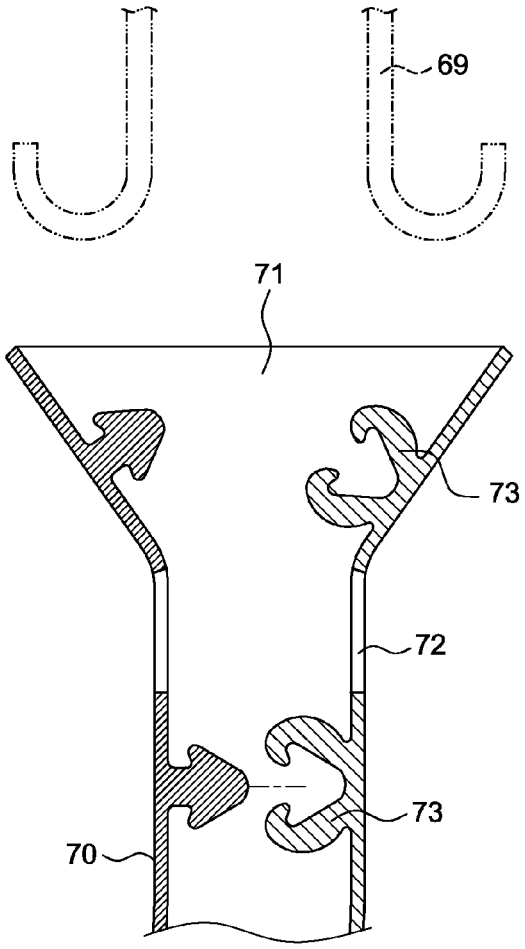
FIG. 7A is a sectional view of a container bag of the excretion device propped open.
Figure 7B:
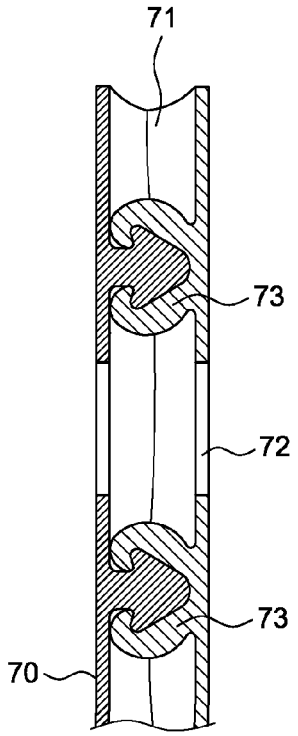
FIG. 7B is a sectional view of the container bag being sealed.

Going back to FIGS. 4-6, the present invention further includes a wash device 80 for washing after excretion. The wash device 80 includes a spray 81, a detachable water container 82, and a tube 84. The spray 81 is disposed between the seat 40 and the crossed members 31 towards the opening 41. The water container 82 is disposed on the chair frame 20 with an outlet 821 connecting to a pump 83. The tube 84 is connecting to the pump 83 with an end and to the spray 81 with the other end.

Figure 9A:
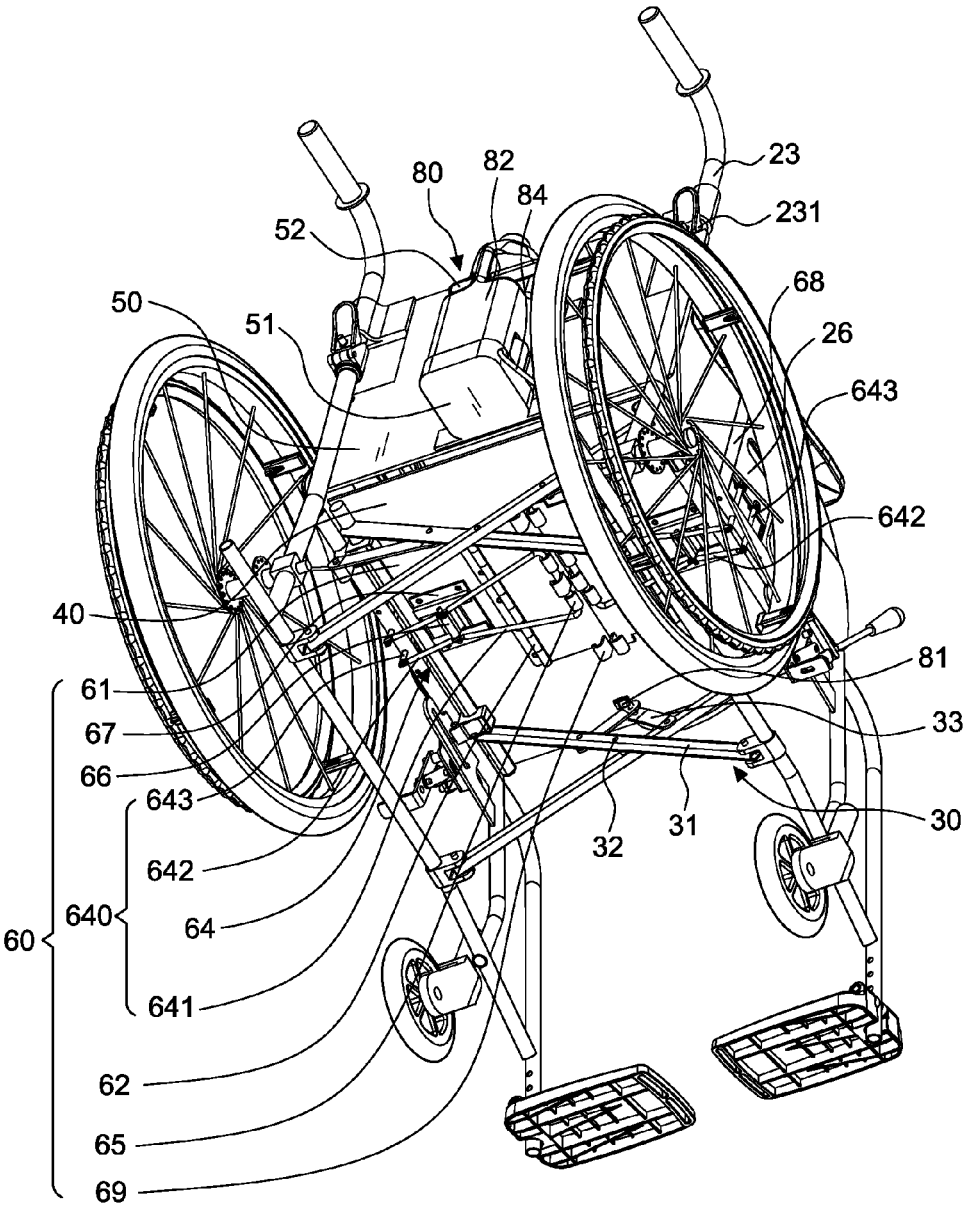
FIG. 9A is another perspective view of the present invention illustrating the excretion device in a normal status ready for operation.
Figure 9B:
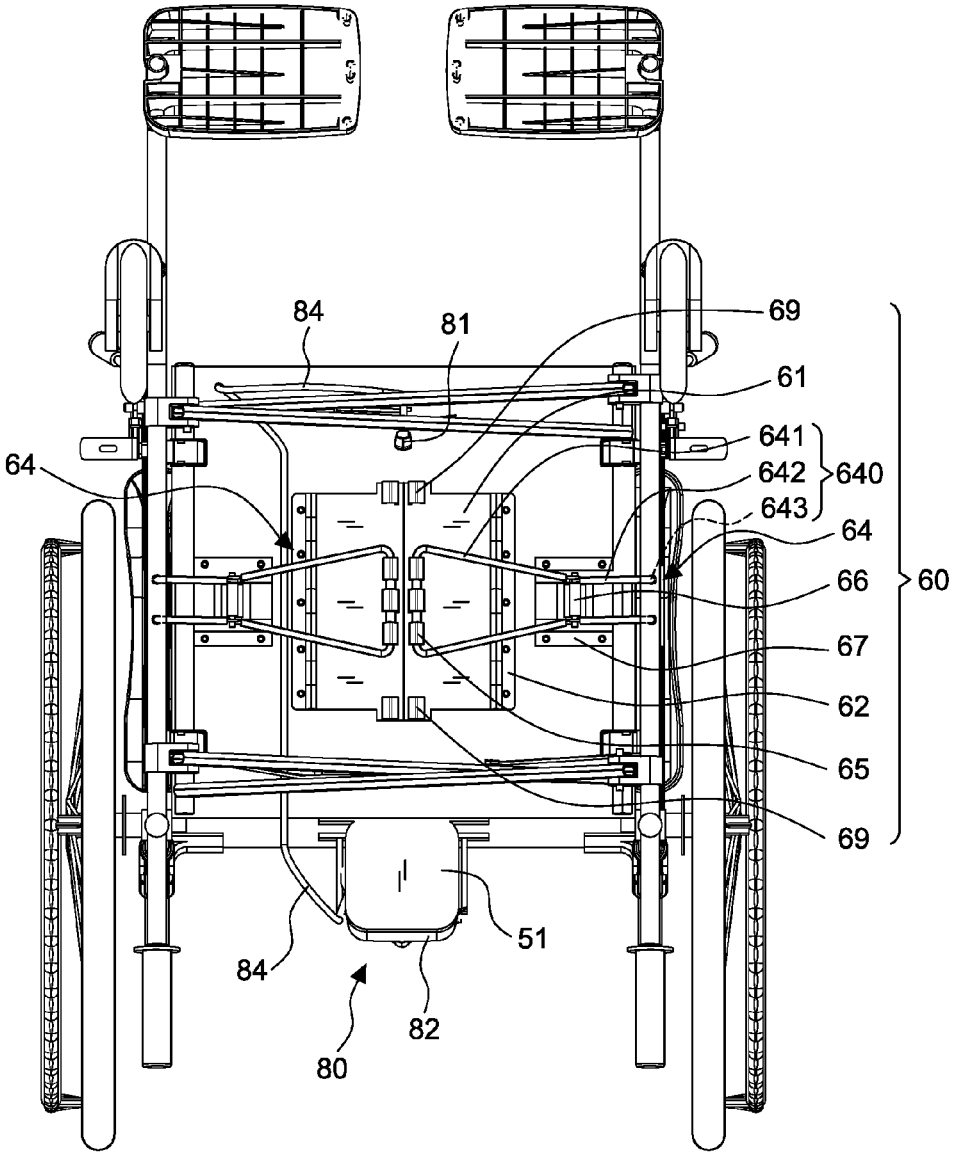
FIG. 9B is a bottom plan view of the present invention without the container bag.
Figure 9C:
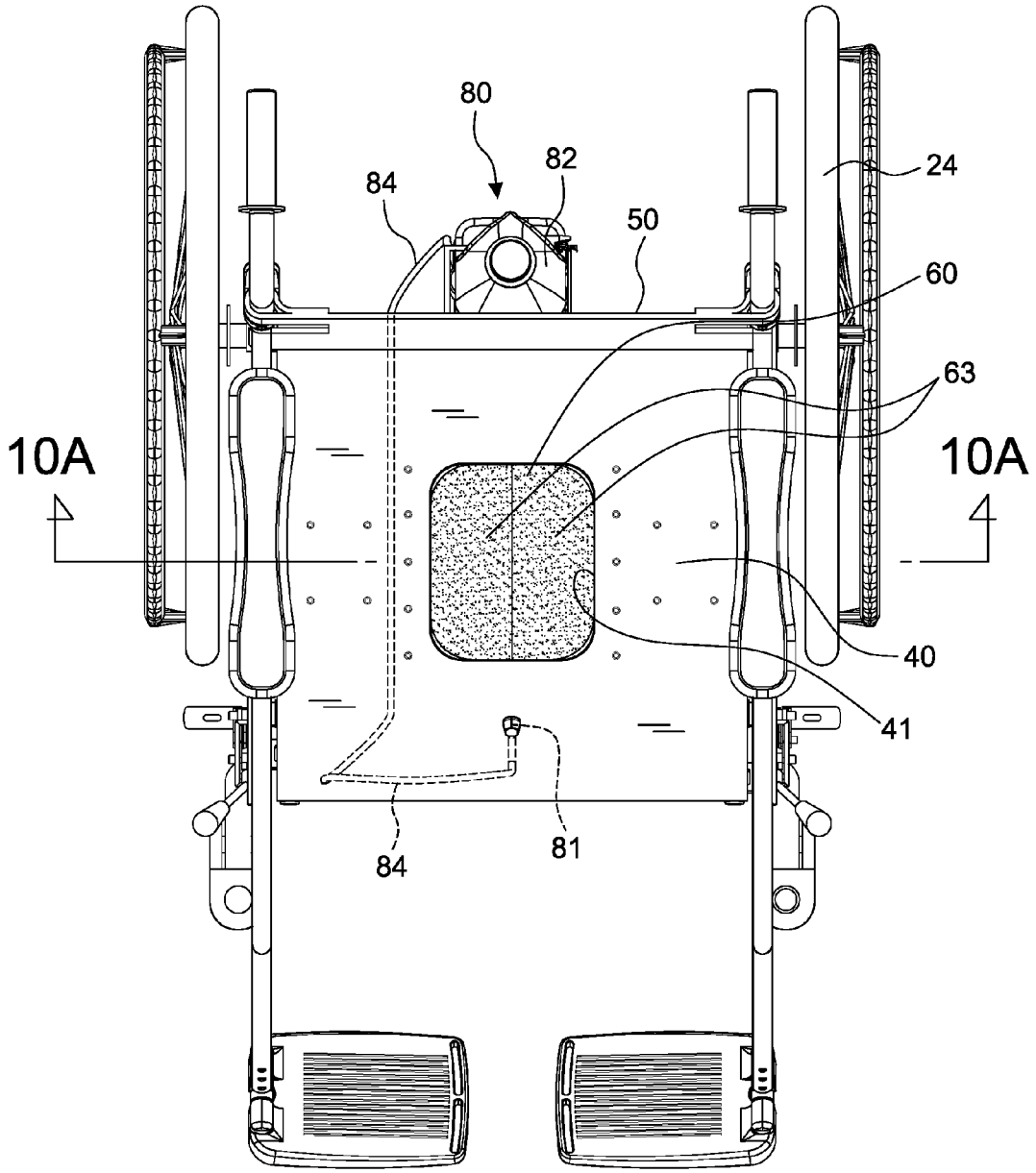
FIG. 9C is a top plan view of FIG. 9A.
Figure 9D:
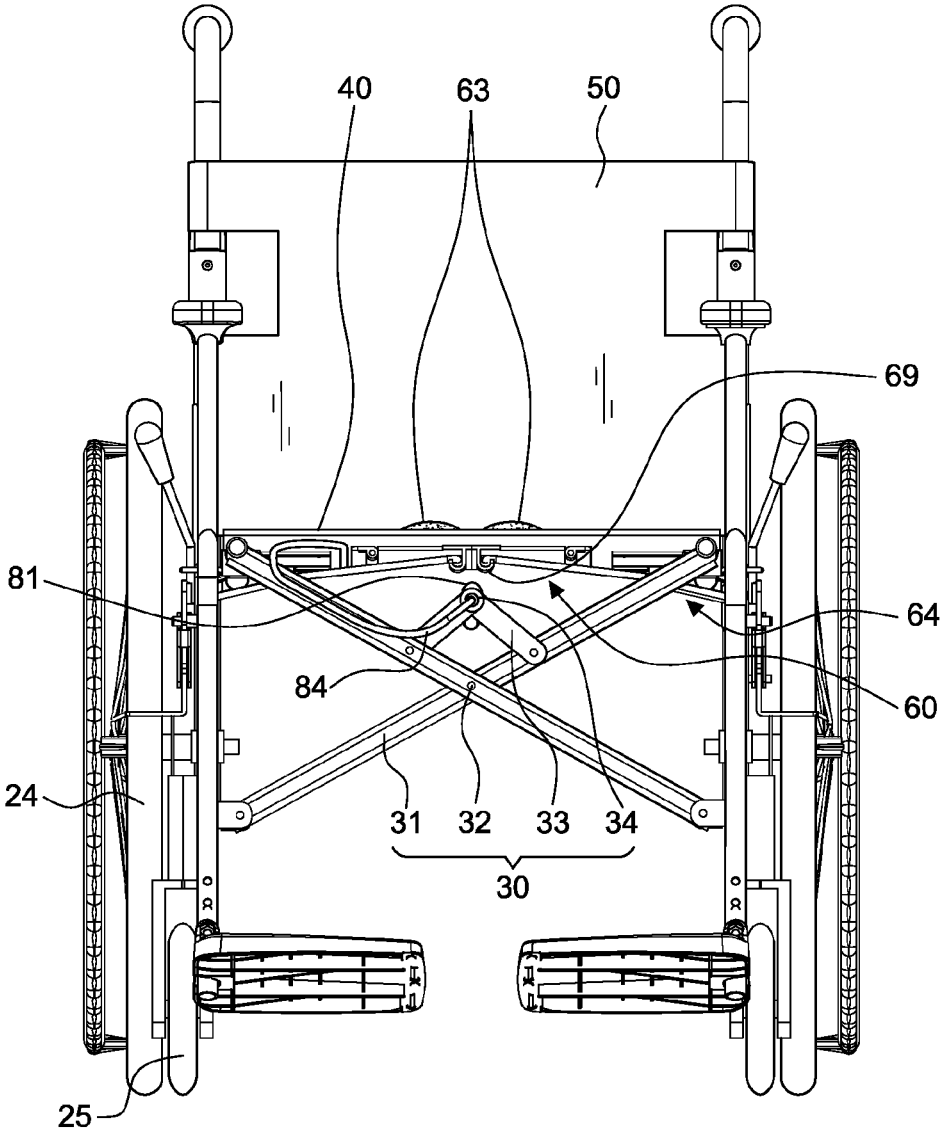
FIG. 9D is a front elevation view of FIG. 9B.

In this embodiment, two engaging pieces 33 are further arranged at an upper section of the crossed members 31, and the engaging pieces 33 are cross engaged by a hollow hinge 34 for the tube 84 of the wash device 80 to engage through and connect to the spray 81 as illustrated in FIG. 9D. Thereby the user on the wheelchair is able to operate the washing device 80 after excretion.

In addition, a base 51 and a belt 52 are further arranged at a rear of the backrest 50 for the water container 82 to be disposed on the base 51 and fastened by the belt 52. The base 51 is made of canvas or clothes with a first inner surface 511 and two second inner surfaces 521 to be fixed to the backrest 50; and the belt 52 is made of straps. When the water container 82 runs out of water, it can be removed from the base 51 by unfastening the belt 52. Also, the water container 82 has a first space 822 aside for disposing the pump 83 and a second space 823 at the other side for installing a battery set 85 to provide power supply for the pump 83. The present invention therefore does not need extra power supple for operation.

All in all, structures of the excretion device 60 and wash device 80 are integrated into the original design of a folding wheelchair to keep the common functions of a normal wheelchair and include extra functions for its users to excrete right on the wheelchair and to conveniently operate washing after excretion. The present invention therefore reduces burdens for both the users and caregivers and saves them from embarrassing situations that they may encounter in daily life.

What is claimed is:

1. A folding wheelchair with an excretion device, comprising:

a foldable chair frame having two symmetrically push handles arranged at a rear thereof and two armrests symmetrically arranged aside thereof;

a cross brace including a plurality of crossed members to be connected to the chair frame for stable folding and unfolding;

a foldable seat connecting the chair frame in-between;

a foldable backrest disposed on a back frame which is connected to the chair frame;

two wheels symmetrically arranged aside the chair frame;

two casters symmetrically arranged under a lower front of the chair frame;

wherein the seat has an opening corresponding to a sitting position of buttocks of human body, and wherein an excretion device is disposed under the opening of the seat, comprising:

two movable boards arranged symmetrically adjacent under the opening with surface areas greater than the opening, each movable board having a near side as a free end, a far side fixed to a bottom surface of the seat by a positioning element, thereby to be opened downwards and closed back, and a pad disposed on an upper surface thereof to fit in the opening when the movable board is closed;

two operate units arranged symmetrically from bottom surfaces of the movable boards to both sides of the chair frame for opening and closing operatof the movable boards, each including a connecting unit having three sets of connecting bars, among which a pair of first connecting bars has an end thereof individually connected to one of the movable boards by a pair of first hinges and the other end thereof individually connected to an end of a pair of second connecting bars by a pair of second hinges; each second hinge further engages a set of sliding chutes for displacement; the second connecting bars having the other ends individually connected to an end of a pair of third connecting bars which displaces along a sliding rail arranged under one of the armrests, thereby opening and closing the connected movable boards with vertical displacement of the third connecting bars;

a plurality of hooks arranged under the adjacent sides of the movable boards along edges thereof; and a container bag made of waterproof materials with an opened end which includes a plurality of holes along adjacent edges of the opened end corresponding to positions of the hooks for the container bag to be hung up under the movable boards and to be propped open for taking excrement when the movable boards are opened.

2. The folding wheelchair with an excretion device as claimed in claim 1, further comprising a wash device, including a spray disposed between the seat and the crossed members towards the opening;

a detachable water container disposed on the chair frame with an outlet connecting to a pump; and a tube connecting to the pump with an end and to the spray with the other end.

3. The folding wheelchair with an excretion device as claimed in claim 2, wherein two engaging pieces are further arranged at an upper section of the crossed members, and the engaging pieces are cross engaged by a hollow hinge for the tube of the wash device to engage through and connect to the spray.

4. The folding wheelchair with an excretion device as claimed in claim 2, wherein a base and a belt are further arranged at a rear of the backrest for the water container to be disposed on the base and fastened by the belt.

5. The folding wheelchair with an excretion device as claimed in claim 4, wherein the water container has a first space aside for disposing the pump and a second space at the other side for installing a battery set to provide power supply for the pump.

6. The folding wheelchair with an excretion device as claimed in claim 1, wherein each pair of the third connecting bars further has a push plate disposed atop for engagement and a lower end of the third connecting bars individually engaging through a through hole arranged correspondingly on the chair frame for operation.

7. The folding wheelchair with an excretion device as claimed in claim 1, wherein the container bag has at least one zipper on adjacent edges of the opened end.

* * * * *